US006392337B1

(12) United States Patent
Yoon et al.

(10) Patent No.: US 6,392,337 B1
(45) Date of Patent: May 21, 2002

(54) CATHODE RAY TUBE

(75) Inventors: Tae-il Yoon; Chong-in Chung; Chang-seok Rho, all of Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/499,732

(22) Filed: Feb. 8, 2000

(30) Foreign Application Priority Data

Feb. 11, 1999 (KR) ..... 99-4823

(51) Int. Cl.[7] ..... H01J 31/00
(52) U.S. Cl. ..... 313/479; 313/478; 313/480
(58) Field of Search ..... 313/479, 478, 313/480

(56) References Cited

U.S. PATENT DOCUMENTS 4,390,637 A * 6/1983 Daiku ..... 501/64
5,965,975 A * 10/1999 Chigusa et al. ..... 313/478
6,091,184 A * 7/2000 De Vries ..... 313/110

* cited by examiner

*Primary Examiner*—Sandra O'Shea
*Assistant Examiner*—Ali Alavi
(74) *Attorney, Agent, or Firm*—Leydig, Voit, & Mayer, Ltd.

(57) ABSTRACT

A cathode ray tube (CRT) having a phosphor screen in which red, green, and blue phosphors are located in a black matrix in a pattern, at the inside of a panel, a low-reflectivity coating layer located at the outside of the panel, the low-reflectivity coating layer having a reflectivity of 2.0% or less near 480~600 nm, wherein the panel is glass containing neodymium (Nd) in a concentration of 0.1~1.5 wt % and praseodymium (Pr) in a concentration of 0.1~0.7 wt %. The CRT has improved brightness and contrast characteristics, and has an enlarged color reproduction range. Also, the problem of the unattractive color of the CRT itself under an external illumination is solved.

9 Claims, 5 Drawing Sheets

CATHODE RAY TUBE

BACKGROUND OF THE INVENTION

1. Field of the Invention

The present invention relates to a cathode ray tube (CRT), and more particularly, to a CRT with enhanced brightness, contrast and color.

2. Description of the Related Art

A CRT is a type of display in which an image is displayed when red (R), blue (B) and green (G) phosphors, which are located in a black matrix (BX) in a dotted or striped pattern, emit colors of light in response to being hit by electron beams emanating from an electron gun.

FIG. 1 is a schematic view of a phosphor screen in a CRT. Light visible to viewers falls into two categories with respect to the light source; one type of light 15 emitted light 1 from phosphors being hit with electrons, and the other type of light is due to the back reflection of ambient light by the CRT. Also, the light reflected by the CRT includes light 2 reflected on the external surface of glass panel in the CRT and light 3 transmitted through the glass and reflected back by phosphors. The lights 1 emitted by the phosphors, having peaks of a predetermined wavelength, is used to display an image in a desired color by the combination of the emitted light 1. Because the ambient light has a continuous wavelength in a visible range, the wavelengths of the reflected ambient light are different to those of the light emitted from the phosphors, thereby lowering the contrast of a screen.

FIG. 2 shows the light emission spectrum of a P22 series phosphor. ZnS:Ag phosphor 1 has a major peak at 450 nm. ZnS:Au,Cu,Al phosphor 2 has a major emission peak at 540 nm with a width of about 130 nm, and $Y_2O_2S$:Eu phosphor 3 has a sharp major emission peak at 630 nm. However, the reflected ambient ray 2 and 3 of FIG. 1 is from a white light source having continuous light spectrum over the entire visible range, so that they include light at the wavelengths between the emission peaks of the phosphors of FIG. 2, unlike the emission of phosphors. Also, the peaks of B and G phosphors, which are broad, overlap each other near 490 nm and 580 nm, so that the contrast and color purity are deteriorated. In order to enhance the color purity in a CRT, the emission and reflection of light near 490 nm and 580 nm should be reduced.

A conventional method for improving the contrast of a CRT screen is to reduce the transmittance of glass in a CRT panel. The glass used in a CRT panel includes a transparent glass having a light transmittance of 75% or more with respect to visible light, a semi-tinted glass having a transmittance of 50~60% or more, and a dark tinted glass having a transmittance of 40~50%. FIG. 3 shows the transmittance distribution of these glasses. In FIG. 3, the transparent glass (a), the semi-tinted glass (c), the dark tinted glass (d) show an essentially constant transmittance over the entire visible range. If the transmittance of glass is lowered in order to enhance contrast, brightness is decreased. Also, if the transmittance is increased, the contrast is lowered while the brightness is enhanced. Thus, both brightness and contrast cannot be enhanced at the same time by adjusting the transmittance.

To solve this problem, technique of adding neodymium (Nd) to glass has been suggested. In FIG. 3, a curve b represents the transmittance distribution of glass containing Nd. The Nd-glass shows a selective transmittance, by having a major absorption peak near 570~590 nm and a minor absorption peak near 520~530 nm. These two absorption bands lie between the light emission regions of to the phosphors, so that the Nd-glass can absorb the light other than the light emission regions without changing the transmittance at the light emission regions of the phosphors, thereby enhancing both brightness and contrast. Also, since the Nd-glass can absorb light near 580 nm, which is very critical in improving the contrast and the color purity, the color purity can be also enhanced.

However, while the Nd-glass can improve the brightness and contrast characteristics, the light blue color of a CRT adopting the Nd-glass may be unattractive to viewers, unlike a black-colored CRT adopting a semi-tinted or dark tinted glass. Also, the reflectivity of a CRT adopting the Nd-glass is not low enough.

SUMMARY OF THE INVENTION

It is an object of the present invention to provide a cathode ray tube (CRT) having a high brightness and enhanced contrast and color reproduction range characteristics.

Accordingly, to achieve the above object, the present invention, as embodied and broadly defined herein, provides a cathode ray tube (CRT) having a phosphor screen in which red, green and blue phosphors are located in a black matrix in a dotted or striped pattern, at the inside of a panel, the CRT comprising a low-reflective coating layer at the outside of the panel, the low-reflective coating layer having a reflectivity of 2.0% or less near 480~600 nm, wherein the panel is formed of glass containing neodymium (Nd) of 0.1~1.5 wt % and praseodymium (Pr) of 0.1~0.7 wt %.

Preferably, the panel further comprises nickel (Ni) and cobalt (Co), and the weight ratio of Ni and Co is greater than 15:1. The low reflective coating layer may comprises: a first coating layer formed of silica; and a second coating layer formed of a material having a refractive index higher than that of silica. Preferably, the material for the second coating layer is selected from the group consisting of indium tin oxide (ITO), antimony tin oxide (ATO) and silver (Ag).

Preferably, the red phosphor is $Y_2O_2S$:Eu, the green phosphor is ZnS:Au,Cu,Al or ZnS:Cu,Al, and the blue phosphor is ZnS:Ag. Also, the red, green and blue phosphors may be coated with red, green and blue pigments, respectively. Preferably, the amount of pigment coated on each phosphor is adjusted such that the reflectivity of a short wavelength is 5% or more lower than that of a long wavelength. Also, any pigment which is common in the art, may be used.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

Figure 1:
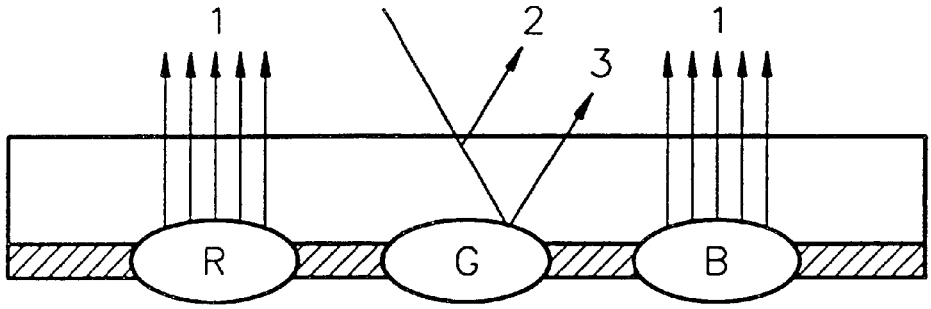
FIG. 1 is a sectional view of a phosphor screen of a cathode ray tube (CRT)
Figure 2:
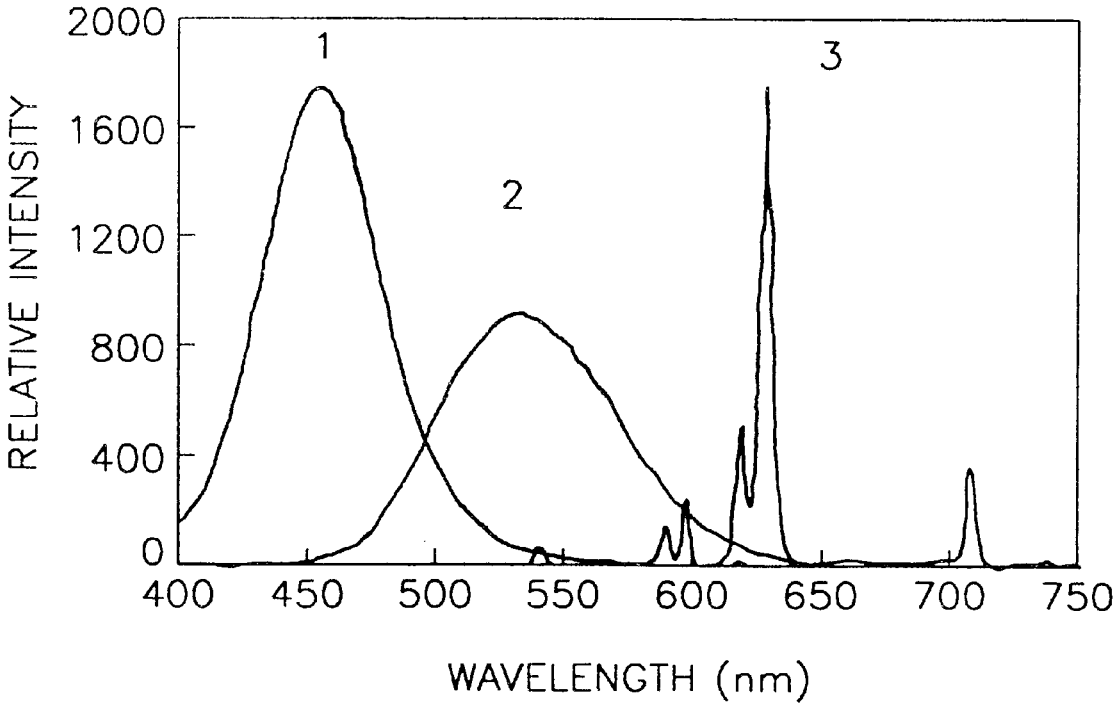
FIG. 2 shows the light emission spectrum of a P22 series phosphor.
Figure 3:
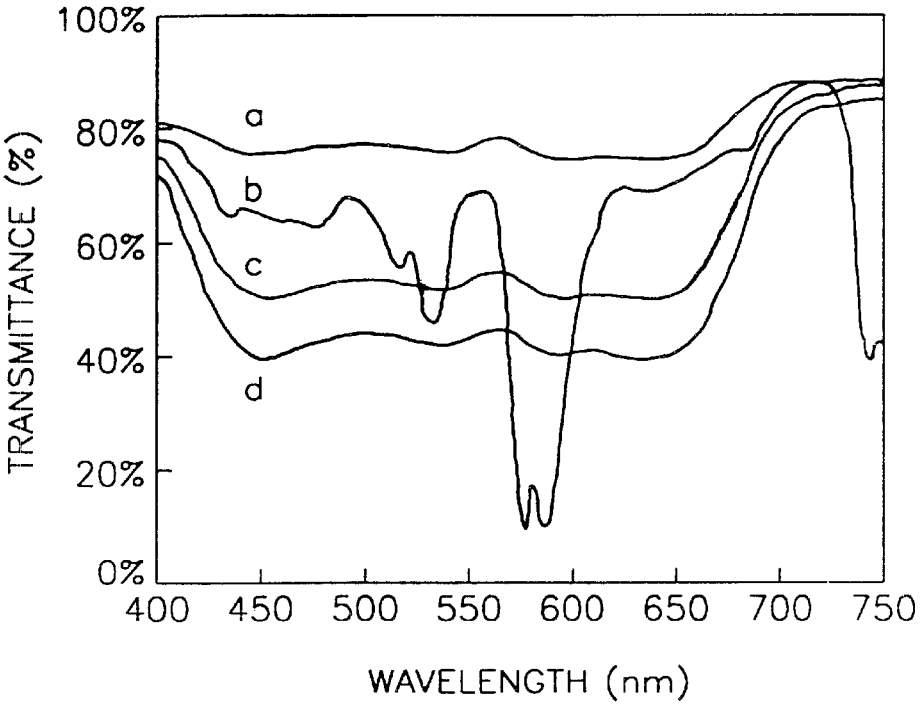
FIG. 3 shows the transmittance distribution with respect to the types of glass used in a CRT.
Figure 4:
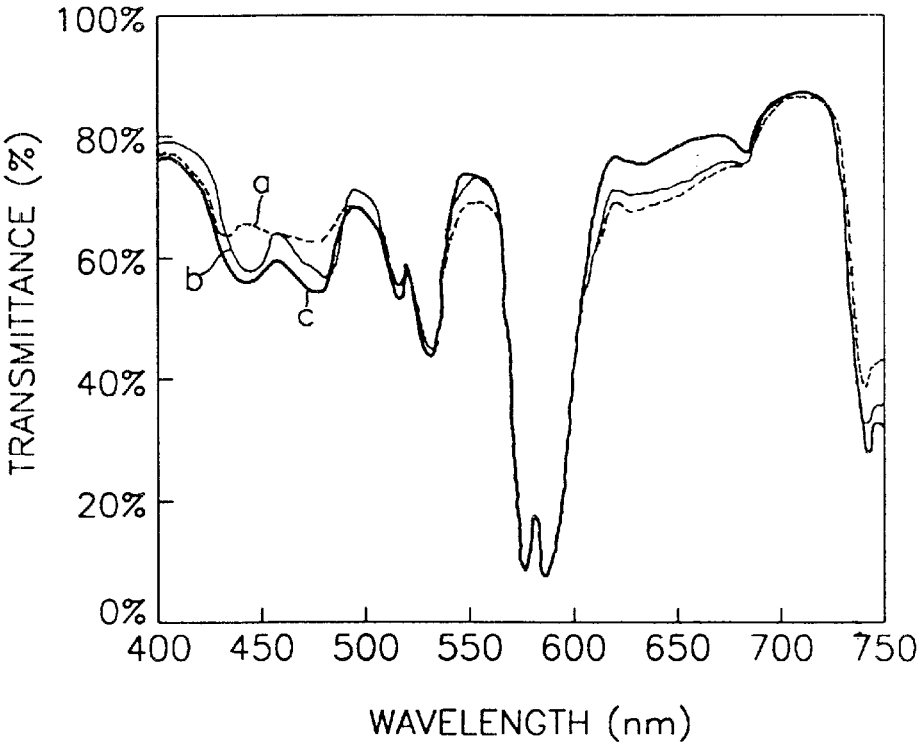
FIG. 4 shows the transmittance distribution of glass with respect to the materials added to the glass.

In FIG. 4, a is a light transmission distribution curve of glass containing neodymium (Nd), b is a light transmission distribution curve of glass containing Nd and praseodymium (Pr), and c is a light transmission distribution curve of glass containing nickel (Ni) and cobalt (Co) in addition to Nd and Pr, wherein the weight ratio of Ni to Co is greater than 15.

In the case of adding Pr as shown in the curve b, a new absorption band is formed near 420~470 nm, so that the transmittance near blue is decreased, thereby reducing undesirable bluish appearance of the panel. Also, the absorption band near 470 nm at the boundary of a blue phosphor peak enhances the color purity. Also, in the case of further adding Ni and Co in a ratio greater than 15:1, the transmittance below 530 nm is lower than that above 530 nm by about 20%, so the panel glass looks less blue.

Preferably, the amount of Nd in the glass is in the range of 0.1~1.5 w % of the glass. If the content of Nd is less than 0.1 wt %, the absorption peak is too small, and the effect of adding Nd is not enough. If the content of Nd exceeds 1.5 wt %, the cost increase overweighs the improvement in brightness and color purity. For these reasons, preferably, the amount of Pr in glass is determined to be in the range of 0.1~0.7 wt %.

Figure 5:
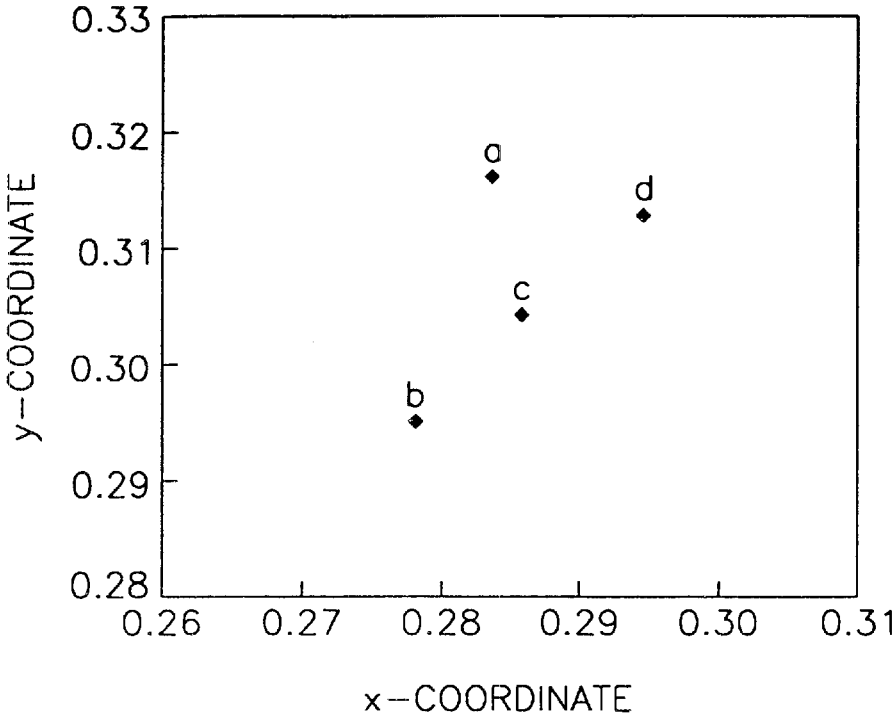
FIG. 5 shows the transmission color coordinates of glass with a P22 light source with respect to the materials added to the glass.

FIG. 5 shows the transmission color coordinates of various types of glass illuminated by a P22 light source. In FIG. 5, a represents the color coordinate of a semi-tinted glass, b represents that of a glass containing Nd, c represents that of a glass containing Nd and Pr, and d represents that of a glass containing Nd, Pr, Ni and Co. As shown in FIG. 5, the color coordinate of the semi-tinted glass is (0.284, 0.316) and the color coordinates of glass which contains Nd is (0.278, 0.295) which is considerably shifted towards the blue tone. However, it can be ascertained that by adding Pr, the color coordinates return towards that of the semi-tinted glass, reaching (0.286, 0.304). Also, in the case where the transmittance at a short wavelength region of 530 nm or less is lowered by further adding Ni and Co in a weight ratio of 15:1, the color coordinates (0.295,0.313) of the glass nearly reach those of a semi-tinted glass.

Here, the X coordinate of the glass containing Nd, Pr, Ni and Co is slightly higher than that of a semi-tinted glass, so that it has a slightly red tinge under a P22 light source or a C light source. However, under a fluorescent light having a strong short wavelength such as those in offices or homes, such a glass has dark blue tinge. Therefore, the CRT according to the present invention, adopting the glass containing Nd, Pr, Ni and Co, appears to have acceptible transmittance color under general lighting conditions.

Figure 6:
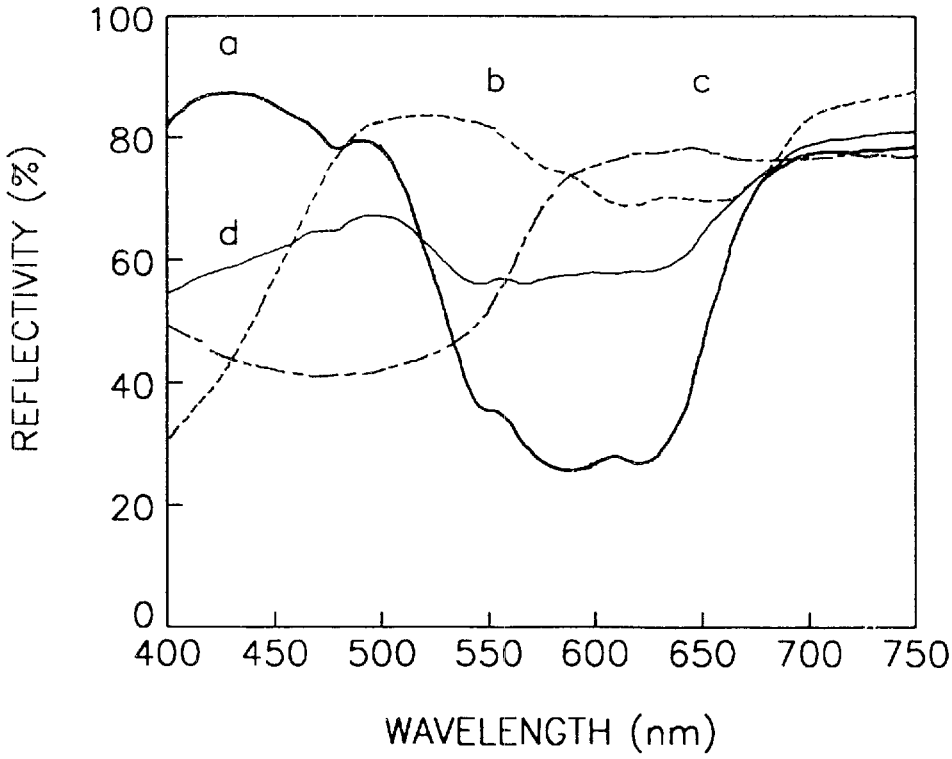
FIG. 6 shows the reflectivity distribution of phosphor coated with a pigment.

FIG. 6 shows the light reflectivity distribution of a phosphor coated with a pigment. In the present invention, $Y_2O_2S$:Eu phosphor may be used for red, ZnS:Au,Cu,Al or ZnS: Cu,Al phosphor may be used for green, and ZnS:Ag may be used for blue. Alternatively, phosphors can be coated with red, green and blue pigments, respectively. Preferably, the amount of pigment coating on each phosphor is determined such that the reflectivity of the ambient light at short wavelengths is lower than that of a long wavelength by 5% or more. Any pigment which is known in the art, may be used.

In FIG. 6, a represents the case of a blue phosphor coated with a blue pigment, b represents the case of a green phosphor coated with a green pigment, c represents the case of a red phosphor coated with a red pigment, and d represents the average transmittance of the three phosphors at each wavelength.

The reflectivity of the red phosphor coated with the red pigment (curve c) drops sharply at wavelengths less than 580 nm while the green phosphor coated with the green pigment (curve b) shows a sharp decrease in reflectivity at 580~650 nm. Also, the reflectivity of the blue phosphor coated with the blue pigment (curve a) sharply decreases near 500~670 nm. In a phosphor screen of the CRT, red, green and blue phosphors are separated from each other in a dotted or striped pattern. Thus, by coating each phosphor with a pigment as described above, reflectivity by the phosphor screen at undesirable wavelengths is suppressed without loss of brightness. Also, the reflectivity distribution over the entire phosphor screen (curve d) is about 15% lower at a short wavelength of 530 nm or less than at a wavelength above 530 nm, so that the color of light reflected by the CRT can be appropriately adjusted, in addition to the reflectivity being decreased.

Figure 7:
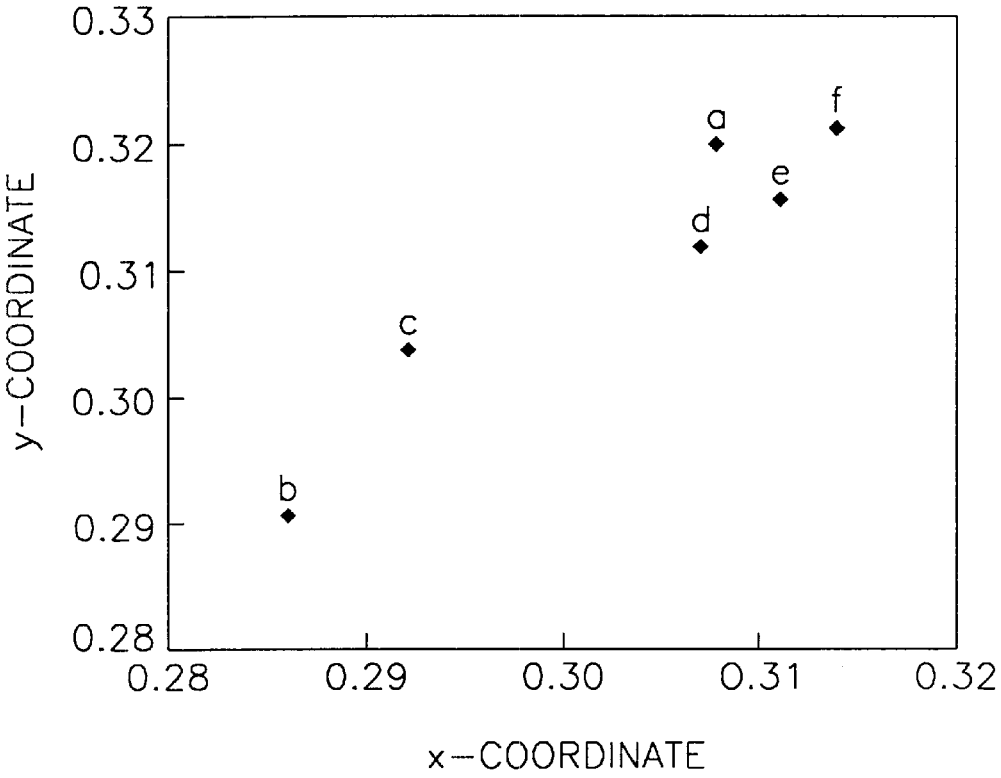
FIG. 7 shows the reflection color coordinates of a CRT manufactured according to various conditions.

FIG. 7 shows the reflection color coordinates of a CRT under a C light source. In FIG. 7, a represents the case where a semi-tinted glass is used with uncoated phosphors, b represents the case where glass containing Nd is used with uncoated phosphors, c represents the case where glass containing Nd and Pr is used with uncoated phosphors, d represents the case where glass containing Nd, Pr, Ni and Co is used with uncoated phosphors, e represents the case where glass containing Nd, Pr, Ni and Co is used with phosphors coated with pigments, and f represents the case where glass containing Nd, Pr, Ni and Co and phosphors coated with pigments are used. In addition, in the case of f, the CRT is coated with a low-reflective coating layer having a reflectivity of 2.0% or less near 480~600 nm.

The color coordinates indicated by a are (0.308, 0.320) while the color coordinates indicated by b were (0.286, 0.291) which appears bluish. However, such a large difference between the two coordinate values can be reduced by adding Pr to the glass containing Nd as shown in the case of c, thus shifting the color coordinates indicated by the curve b to (0.292, 0.304). Also, the color coordinates are further shifted to (0.307, 0.312) when Ni and Co are added to the glass containing Nd and Pr in a weight ratio greater than 15:1, such that the glass has nearly the same color as a semi-tinted glass. Also, in the case of e where phosphors are coated with pigments in order to improve the contrast and color of a CRT itself are adopted together with the glass containing Nd, Pr, Ni and Co, the color coordinate is (0.311, 0.316). Also, the reflection color of the CRT can be further improved by applying coating a low-reflective coating layer having a minimum reflectivity of 2.0% or less near 480~600 nm on the surface of the glass (f) which causes an interference color complementary to the color of the CRT. The color coordinate of the case of f is (0.314, 0.321). From these results, it can be ascertained that the reflection color coordinate of the CRT can be close to those of semi-tinted glass by coating with a low-reflective coating. layer producing an interference color complementary to the color of the CRT.

Preferably, the low-reflective coating layer includes a first coating layer made of silica and a second coating layer made of a material having a refractive index higher than that of silica. Also, the first and second coating layers may be repeatedly deposited to form a multiple layered structure. Preferably, the second coating layer may include a plurality of layers, wherein the refractive index of each layer sequentially changes. Materials used for the second coating layer may include indium tin oxide (ITO), antimony tin oxide (ATO) and silver (Ag).

The X coordinate values under a C light source are slightly higher than those of semi-tinted glass. However, under a fluorescent light having a strong short wavelength, such as the light in offices or homes, the CRT appears to have a dark blue tinge. Thus, the CRT according to the present invention is acceptable under various ordinary light sources.

Figure 8:
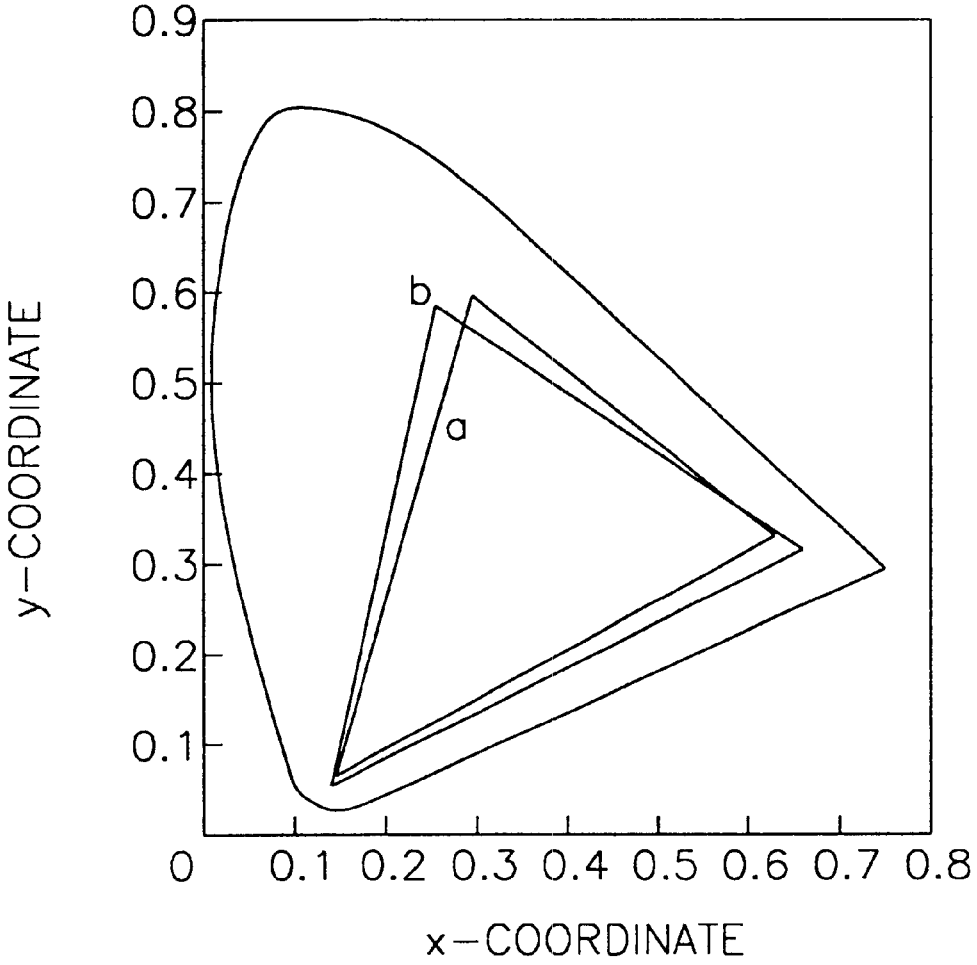
FIG. 8 comparatively shows the color reproduction range of a CRT according to an embodiment of the present invention, and that of a conventional CRT.

FIG. 8 comparatively shows the color emission range of a CRT according to the present invention and that of a conventional CRT. In FIG. 8, a corresponds to the case of a of FIG. 7 and b corresponds to the case of f of FIG. 7. The color emission range a in the case where a semi-tinted glass and uncoated phosphors are used, is obtained from three single color coordinates including R (0.630, 0.330), B (0.143, 0.066) and G (0.295, 0.596). Also, the color emission range b in the case where glass containing Nd and Pr, and Ni and Co in a weight ratio greater than 15:1, and pigment coated phosphors were used, and a low-reflective coating layer having a low reflectivity near 480~600 nm was formed, was obtained from three single color coordinates including R (0.660, 0.315), B (0.140, 0.055) and G (0.255, 0.558). As can be seen in FIG. 8, the color emission range b of the CRT according to the present invention is enlarged compared to the color emission range a.

The major absorption band near 570~590 nm and the minor absorption band near 520~530 nm, formed by Nd, and the minor absorption band near 420~470 nm formed by Pr are located at the boundary of the light emission regions of phosphors, thereby effectively suppressing the emission and reflection of light which may lower the contrast and color purity of a CRT. As a result, the purity of a single color of light emitted by each phosphor is improved, enlarging the color reproduction range of the CRT.

As described above, in the CRT according to the present invention, the brightness is improved by about 20%, the contrast is improved by about 20% and the color reproduction range is improved by about 30% compared to the CRT adopting a semi-tinted glass and uncoated phosphors. Also, the reflection color of a CRT itself, which becomes unattractive by adding Nd to glass as in the prior art, can be enhanced.

The CRT according to the present invention has improved both the brightness and contrast characteristics, and has an enlarged color reproduction range. Also, the unattractive color of the CRT itself under an external illumination can be lessened.

What is claimed is:

1. A cathode ray tube (CRT) comprising:

a glass panel containing elemental neodymium in a concentration of 0.1–1.5 wt % and elemental praseodymium in a concentration of 0.1–0.7 wt %, a phosphor screen in which red, green, and blue phosphors are located in a black matrix in a pattern, at an inside of the panel, and a low-reflectivity coating layer at an outside of the panel, the low-reflectivity coating layer having a reflectivity of no more than 2.0% near 480–600 nm, the low-reflectivity coating layer including a first coating layer of silica, and a second coating layer of a material having a refractive index higher than silica and selected from the group consisting of indium tin oxide, antimony tin oxide, and silver.

2. The cathode ray tube of claim 1, wherein the panel further comprises nickel and cobalt.

3. The cathode ray tube of claim 2, wherein the weight ratio of Ni to Co is greater than 15:1.

4. The cathode ray tube of claim 1, wherein the low-reflectivity coating layer includes a plurality of the first and second coating layers laminated on each other.

5. The cathode ray tube of claim 1, wherein the second coating layer includes a plurality of layers, the refractive index of each layer is different, and the refractive index of the layers sequentially changes.

6. The cathode ray tube of claim 4, wherein the second coating layer includes a plurality of layers, the refractive index of each layer is different, and the refractive index of the layers sequentially changes.

7. The cathode ray tube of claim 1, wherein the red phosphor is $Y_2O_2S$: Eu, the green phosphor is one of ZnS:Au,Cu,Al, and ZnS:Cu,Al, and the blue phosphor is ZnS:Ag.

8. The cathode ray tube of claim 7, wherein the red, green, and blue phosphors are coated with red, green, and blue pigments, respectively.

9. The cathode ray tube of claim 8, wherein the amount of pigment coating each phosphor is adjusted such that the reflectivity of a short wavelength is at least 5% less than that of a long wavelength.

* * * * *